US011598138B2

(12) United States Patent
Bakalyar

(10) Patent No.: US 11,598,138 B2
(45) Date of Patent: Mar. 7, 2023

(54) BARGE LID GRAIN DOOR OPENING APPARATUS

(71) Applicant: Bakalyar Enterprises, LLC, Murfreesboro, TN (US)

(72) Inventor: Michael Bakalyar, Quincy, IL (US)

( * ) Notice: Subject to any disclaimer, the term of this patent is extended or adjusted under 35 U.S.C. 154(b) by 523 days.

(21) Appl. No.: 16/680,546

(22) Filed: Nov. 12, 2019

(65) Prior Publication Data

US 2020/0149338 A1 May 14, 2020

Related U.S. Application Data

(60) Provisional application No. 62/758,527, filed on Nov. 10, 2018.

(51) Int. Cl.
*E05F 9/00* (2006.01)
*E05F 15/53* (2015.01)

(52) U.S. Cl.
CPC ..... *E05F 15/53* (2015.01); *E05Y 2201/602* (2013.01); *E05Y 2201/612* (2013.01); *E05Y 2201/624* (2013.01); *E05Y 2201/63* (2013.01); *E05Y 2201/64* (2013.01); *E05Y 2201/688* (2013.01); *E05Y 2600/312* (2013.01); *E05Y 2900/514* (2013.01); *E05Y 2900/604* (2013.01)

(58) Field of Classification Search
CPC ..... E05F 15/53; E05Y 2201/602; E05Y 2201/612; E05Y 2201/624; E05Y 2201/63; E05Y 2201/688; E05Y 2600/312; E05Y 2900/514; E05Y 2900/604; B63B 19/14; B63B 19/24; B63B 19/28; B63B 25/06; B65D 90/48; B65D 90/54; B66C 23/06
USPC ..... 49/356, 357
See application file for complete search history.

(56) References Cited

U.S. PATENT DOCUMENTS 4,260,313 A * 4/1981 Van Dusen ..... B65D 90/54 52/196
4,598,496 A * 7/1986 Van Daele ..... B65D 90/623 49/357
4,744,183 A * 5/1988 Kruger ..... B65D 90/623 220/264

(Continued)

FOREIGN PATENT DOCUMENTS

EP 3216532 A1 * 9/2017 ..... B05B 12/14
GB 2047330 A * 11/1980 ..... B64D 33/02
WO WO-2020112717 A1 * 6/2020 ..... B65D 90/10

*Primary Examiner* — Jerry E Redman
(74) *Attorney, Agent, or Firm* — Waller Lansden Dortch & Davis, LLP; Blake M. Bernard

(57) ABSTRACT

An apparatus is disclosed for opening and closing a grain or access door on a barge lid or cover, the grain door having a latch connecting the grain door to the barge lid, the apparatus supportable by an overhead lifting system. The apparatus can include a base which is supportable by the overhead lifting system and a mechanical arm assembly connected to the base, the mechanical arm assembly including a first arm rotatably connected to the base, a second arm connected to the first arm, a latch engagement member connected to the second arm; and an actuator connected between the first arm and the second arm, the actuator operable to move the second arm relative to the first arm to disengage the latch on the grain door from the barge lid via the latch engagement member and swing the grain door from a closed position to an open position.

18 Claims, 16 Drawing Sheets

(56) References Cited

U.S. PATENT DOCUMENTS

| | | | | |
|---|---|---|---|---|
| 5,218,784 | A * | 6/1993 | Pollock | B65D 90/10 52/192 |
| 8,066,140 | B1 * | 11/2011 | Young | E05C 3/045 292/256.5 |
| 9,919,867 | B1 * | 3/2018 | Poncsak | B65D 90/623 |
| 10,221,602 | B2 * | 3/2019 | Sewell | E05F 1/1091 |
| 2020/0149338 | A1 * | 5/2020 | Bakalyar | B63B 19/14 |
| 2021/0198934 | A1 * | 7/2021 | Trotter | E05F 15/63 |
| 2021/0402953 | A1 * | 12/2021 | Polisetty | E05D 15/46 |

* cited by examiner

BARGE LID GRAIN DOOR OPENING APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. Patent Application No. 62/758,527 filed Nov. 10, 2018 entitled BARGE LID GRAIN DOOR OPENING APPARATUS, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to the opening and closing of grain doors or other access doors positioned on barge lids or barge covers.

Conventional barges include multiple barge lids or covers positioned in sequence over a large container of a barge. Barge lids or covers can be equipped with grain or material access openings through which grain or other materials can be loaded into a barge container while the barge lid or covers are secured to the barge container. The barge lids or covers can include grain doors that can be pivotally connected to the barge lid and movable between an open position and closed position over the grain or material access in the barge lid or cover. The grain door can be opened to facilitate loading or filling of the barge container and subsequently closed to protect the loaded materials from the elements or other contamination.

The current practice of loading barges with material include placing the barge lids or covers over the container, and filling the barge container through subsequent grain or material accesses in the barge lids to evenly distribute the load within the barge container. Loading through subsequent grain or material accesses in barge lids or covers requires that personnel be deployed on the barge and on top of the barge lids or covers to manually unlatch and open the grain doors in sequence as the container is being filled, watch the material pile to direct filling, close and latch the grain door, remove dust and debris from the cover and move onto the next grain door.

Having personnel climb on top of a barge lid can be dangerous and poses a safety risk as personnel can be prone to falling or slipping on the barge cover, particularly in wet or icy conditions. In some instances, personnel may fall off the barge cover and into nearby water, which poses a drowning risk. Grain doors can also be heavy and cumbersome to open, and a manual process can be time consuming as personnel may climb off and onto subsequent barge lids or covers repeatedly between opening and closing procedures as to not interfere with movement of a grain or other material pump being moved into position over a barge cover to fill the barge container. Both the safety risk and the inefficiencies associated with a manual opening and closing process are undesirable.

What is needed then are improvements to methods and systems for opening and closing grain or access doors on barge lids or covers.

SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An apparatus is disclosed for opening and closing a grain or access door on a barge lid or cover, the grain door having a latch connecting the grain door to the barge lid, the apparatus supportable by an overhead lifting system. The apparatus can include a base supportable by the overhead lifting system and a mechanical arm assembly connected to the base, the mechanical arm assembly including a first arm rotatably connected to the base, a second arm connected to the first arm, a latch engagement member connected to the second arm; and an actuator connected between the first arm and the second arm, the actuator operable to move the second arm relative to the first arm to disengage the latch on the grain door from the barge lid via the latch engagement member and swing the grain door from a closed position to an open position.

In some embodiments, the first arm can be rotatably connected to the base such that the first arm, and thus the second arm, can be rotated as desired to alternate the position of the mechanical arm assembly above the grain door between a position suitable for opening the grain door and a second position suitable for closing the grain door. In some embodiments, the base can be rotatably connectable to the crane, hoist, of other overhead lifting system, and the mechanical arm asssembly can be spaced laterally from a connection point between the base and the overhead Ifiting system, such that the mechanical arm assembly can be rotated via the base to opposing sides of the connection point between the overhead lifting system and the base. In applications with barge lids or covers having multiple grain doors on either lateral side of the barge lid or cover, the base can be rotated with respect to the overhead lifting system to position the mechanical arm assembly over one grain door or the other as needed.

In some embodiments, a blower assembly can be mounted either on the base or on various components of the mechanical arm assembly and oriented to force air in a downward direction over the barge lid to clean off the barge lid when the loading process is completed and the grain door is shut. In other embodiments, a water cleaning system can be mounted to the apparatus instead of a blower assembly, the water cleaning system configured to force water over the barge lid or cover to remove any grain or other debris from the barge lid or cover 14. In some embodiments, one or more guide cameras can be positioned on the apparatus and oriented toward the second arm of the mechanical arm assembly to help an operator engage a latch of the grain door with the mechanical arm assembly.

The apparatus of the present disclosure can help eliminate the need for personnel to manually climb up onto a barge lid or cover, and then open and close the grain doors or access doors during a loading or filling operation.

Numerous other objects, advantages and features of the present disclosure will be readily apparent to those of skill in the art upon a review of the following drawings and description of a preferred embodiment.

DETAILED DESCRIPTION

Figure 1:
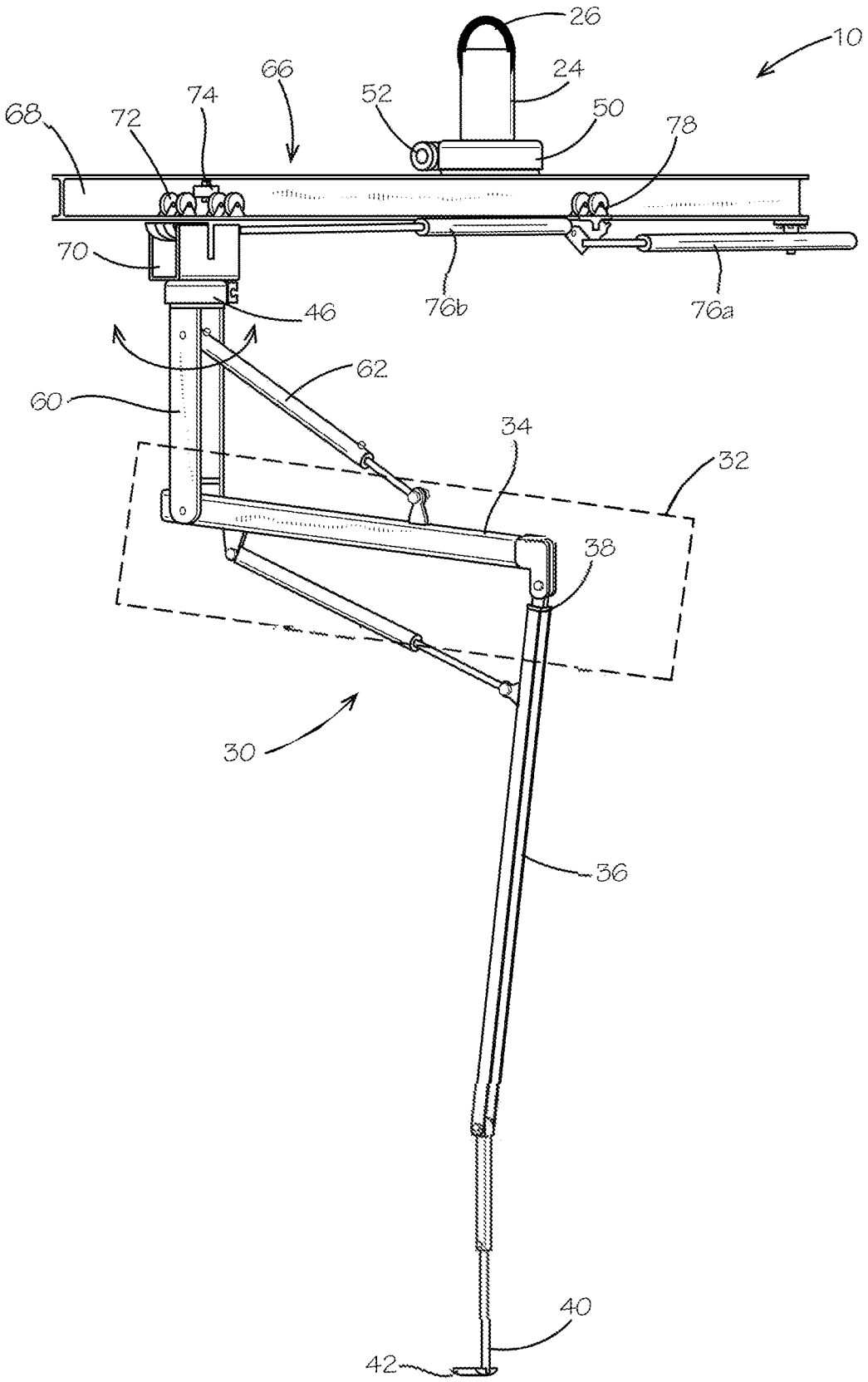
FIG. 1 is a perspective view of one embodiment of an apparatus of the present disclosure for opening a barge lid grain door.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

One aspect of the present disclosure is an apparatus 10 to help provide automated barge cover grain door opening and closing, and in some embodiments, monitoring of the material loading, and cleaning of the barge cover after filling is completed. The apparatus 10 can be suspended or supported by an overhead lifting system such as a crane or hoist system to accommodate site requirements and allow the apparatus to be moved into and out of a desired position over a grain door on a barge lid or cover as desired. In some embodiments, hoist systems can be mounted to fixed overhead structures, such as in an enclosed dock facility.

Various embodiments of an apparatus 10 for opening and closing a grain door 12 on a barge lid 14 are shown in FIGS. 1-20. A grain door or access door 12 on a barge lid 14 can have a latch 16 connecting the grain door 12 to the barge lid 14. The latch 16 can be a simple pivoting latch with a latch handle 18 that can be grasped or engaged to rotate the latch 16 about a pivot point to engage and disengage the latch 16 with a lip 20 around a grain or material access opening 22 defined in the barge lid or cover 14.

Figure 15:
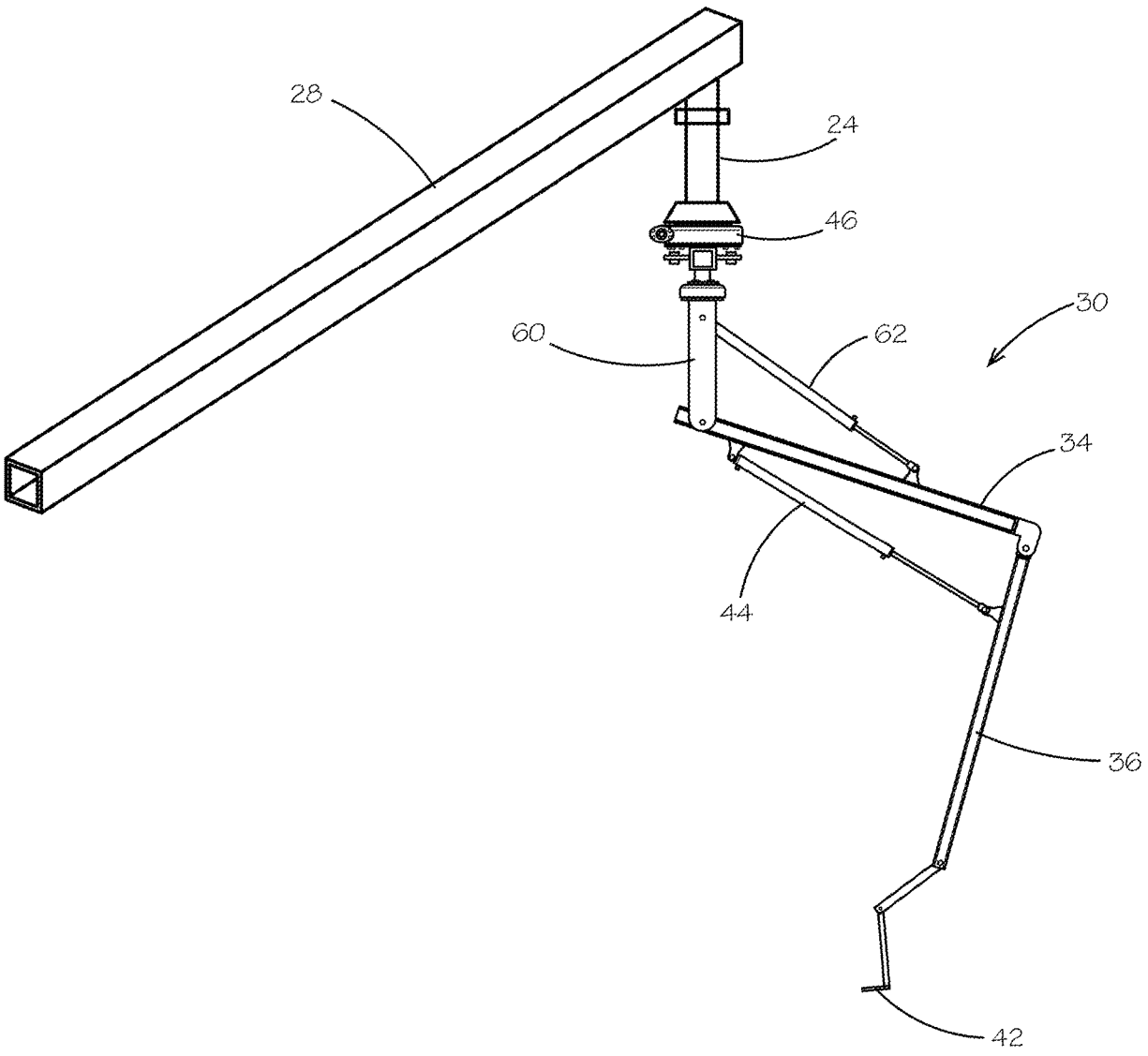
FIG. 15 is a perspective view of another embodiment of an apparatus of the present disclosure showing a base of the apparatus rigidly connected to the boom of traditional crane lifting system.

The apparatus can include a base 24 connectable or supportable by an overhead lifting system such as a crane or hoist. In some embodiments, the base 24 can include a hook loop 26 which can be engaged by a hook on a crane or hoist to lift the apparatus 10 via the crane or hoist by the crane loop 26 on the base 24. In other embodiments, the base 24 can be rigidly or fixedly connected to a boom of a crane or hoist, or another component of an overhead lifting system 28, as shown in FIG. 15. In some embodiments, such as in enclosed barge docks, a hoist can be secured to a fixed overhead structure such as a roof of the dock enclosure. The lifting system can be utilized to move the apparatus 10 in both a vertical and/or horizontal direction to positon the apparatus of a desired grain or access door 12 on a barge lid or cover 14. In other embodiments, the apparatus 10 can be maintained in a generally fixed horizontal and lateral position and the barge itself can be moved beneath the apparatus 10 to position the apparatus 10 over grain doors 12 in sequence during a filling operation. Vertical positioning of the apparatus 10 may need to be adjusted from time to time given the general varying dimensions of different barges, changes in water levels, or the change in the height of a barge above water level as the barge is loaded.

Figure 9:
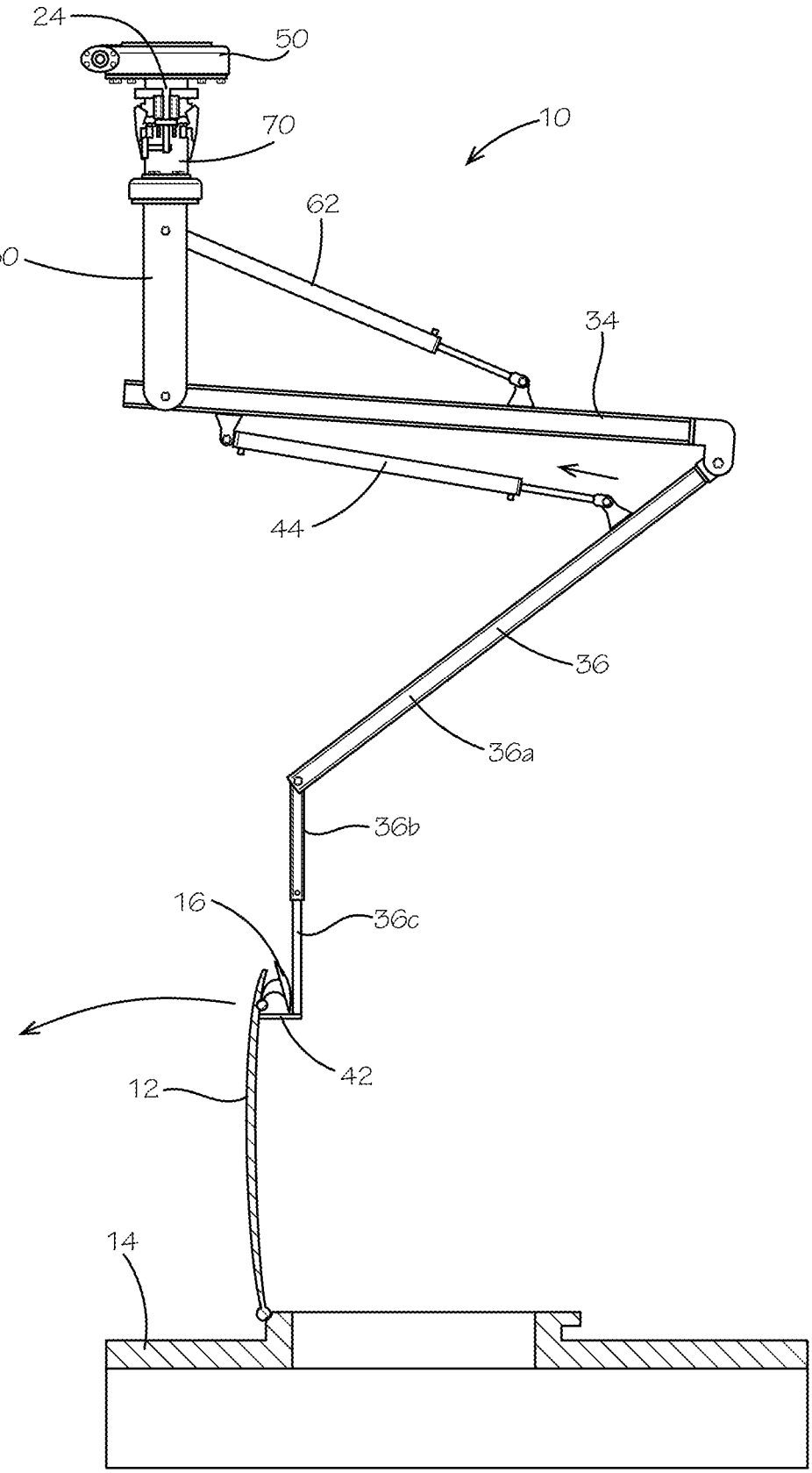
FIG. 9 is a side view of the apparatus of FIG. 6 with a first actuator retracted to disengage the latch of the grain door from the barge lid and swing open the grain door via the mechanical arm assembly of the apparatus.
Figure 10:
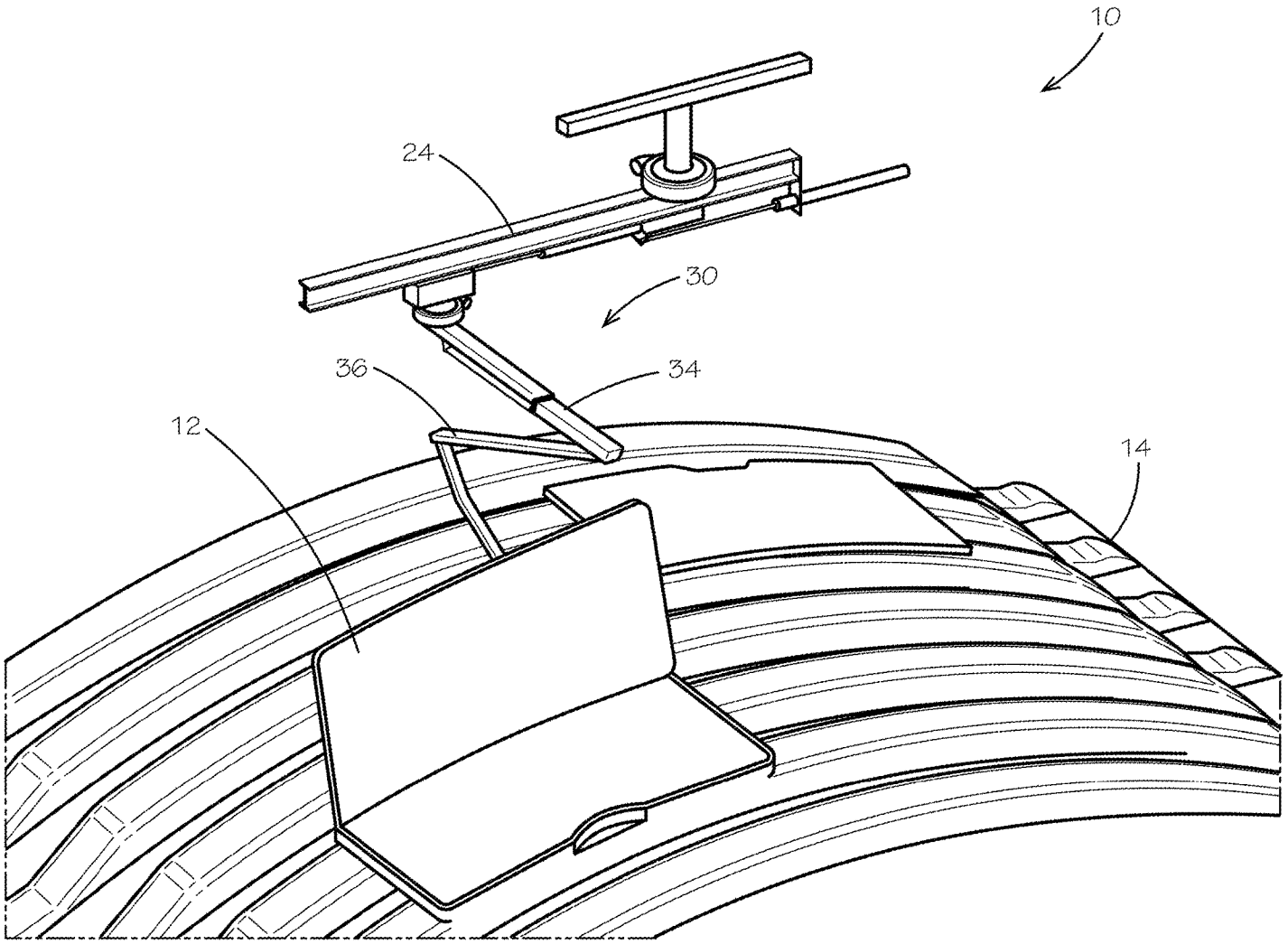
FIG. 10 is a perspective view showing the apparatus of FIG. 9 swinging a grain door open.
Figure 11:
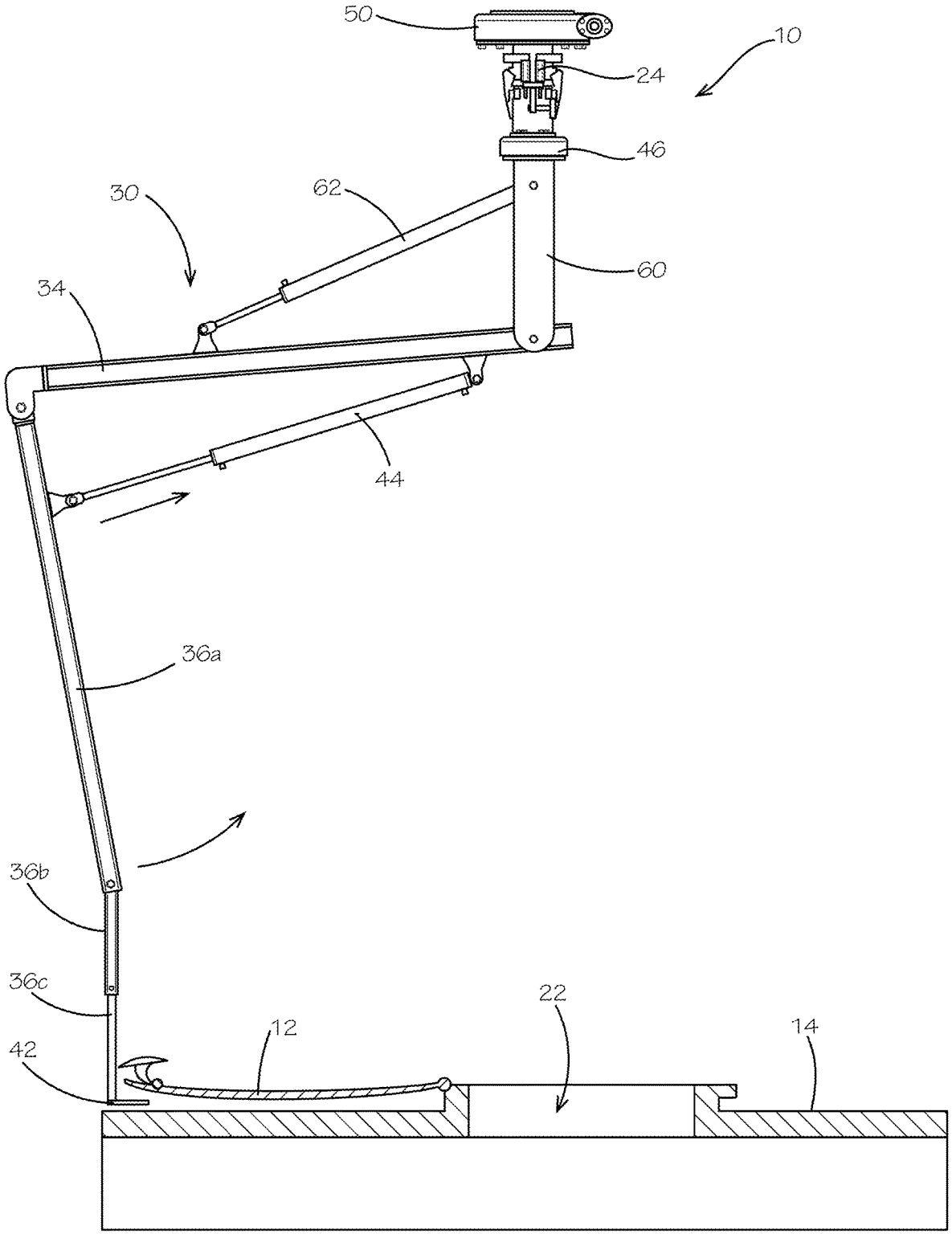
FIG. 11 is a side view of the apparatus of FIG. 9 with the mechanical arm assembly rotated to a position suitable for engaging and closing the grain door.
Figure 12:
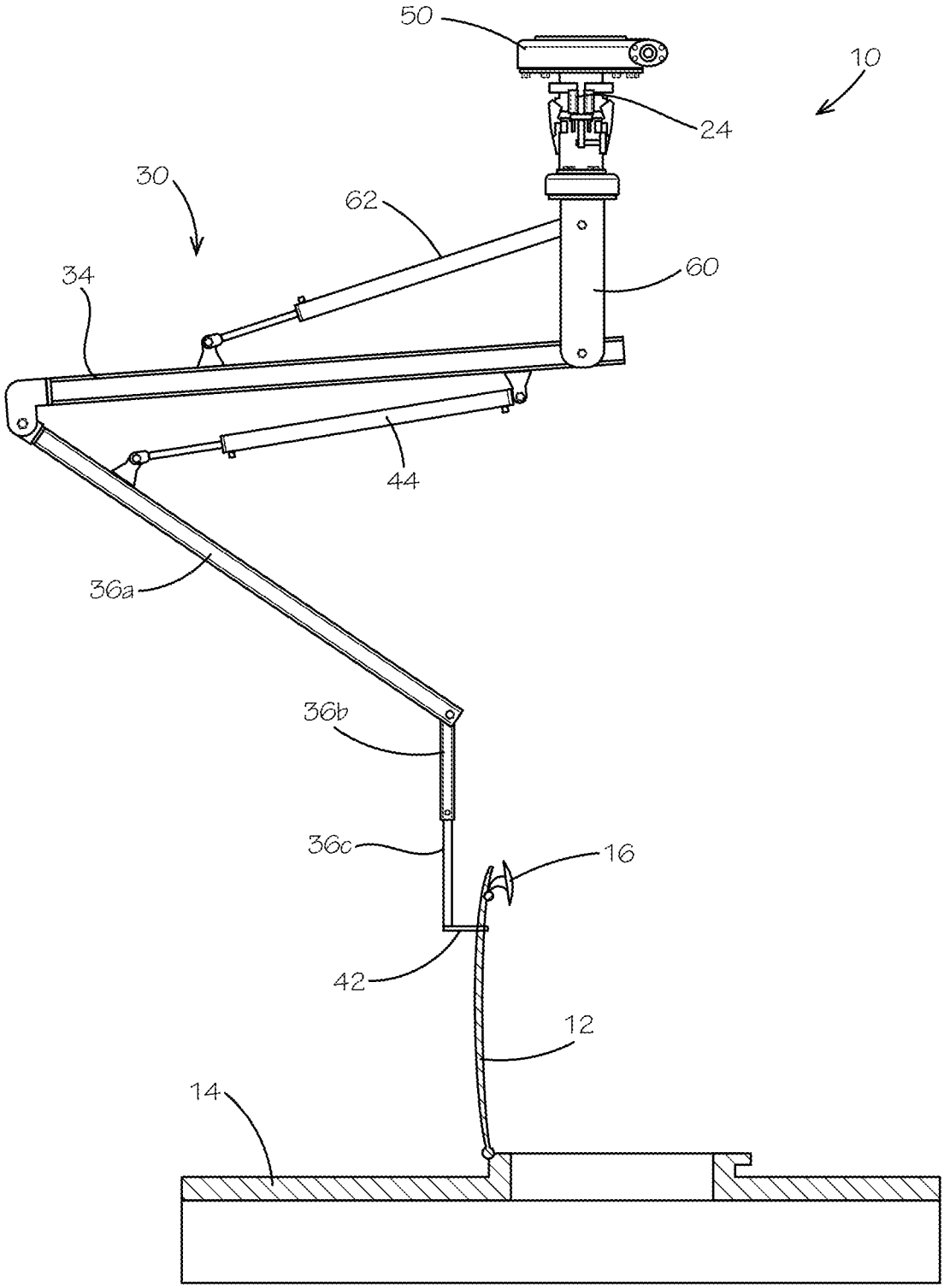
FIG. 12 is a side view of the apparatus of FIG. 11 as the first actuator is retracted to swing the grain door to a closed position.

Referring again to FIGS. 1-12, a mechanical arm assembly 30 can be connected to the base 24. In some embodiments, the mechanical arm assembly 30 can be rotatably connected to the base 24 such that the base 24 can generally remain in a consistent position over a grain door 12 and the mechanical arm assembly 30 can be rotated on the base 24 to vary the mechanical arm assembly 30 between a first position suitable for opening the grain door 12 as shown in FIGS. 6 and 9, and a second position suitable for closing the grain door 12 as shown in FIGS. 11-12, without having to substantially move the base 24 via the crane, hoist, or other overhead lifting device.

Referring now to FIGS. 1-6, the mechanical arm assembly 30 can include a first arm 34 rotatably connected to the base 24. A second arm 36 can have a proximal end 38 and a distal end 40, the proximal end 38 being pivotally connected to the first arm 34. A latch engagement member 42 can be connected to and extend from the distal end 40 of the second arm 36. An actuator 44 can be connected between the first arm 34 and the second arm 36, the actuator 44 operable to move the second arm 36 relative to the first arm 34 when the apparatus 10 is positioned over the grain door 12 to disengage the latch 16 on the grain door 12 from the barge lid 14 via the latch engagement member 42 and swing the grain door 12 from a closed position to an open position.

In some embodiments, when the apparatus 10 is supported by the overhead lifting structure, the first arm 34 can be rotatable about the base 24 along a horizontal plane 32, and the second arm 36 can extend in a downward direction from the first arm 34. As such, the first arm 34 can extend radially or longitudinally outward from the base 24 and be rotatable to vary to position of the second arm 36 over the grain door depending on whether the grain door needs to be opened or closed, and the second arm 36 can extend downward to engage the latch 16 of the grain door 12 with the latch engagement member 42. In some embodiments, the first arm 34 can be rotatable relative to the base 24 through at least 180 degrees of rotation. In other embodiments, the first arm 34 can be rotatable relative to the base 24 through 360 degrees of rotation.

In some embodiments, the first arm 34 can be connected to the base 24 via a first slewing bearing 46 such that the first arm 34 is rotatable relative to the base 24 via the first slewing bearing 46. The first slewing bearing 46 can include a first or inner ring connected to the base 24 and an outer or second ring which is connected to the mechanical arm assembly 30 and rotatable relative to the inner ring to rotate the mechanical arm assembly 30 relative to the base 24. In some embodiments, the first slewing bearing 46 can be motorized such that rotation of the mechanical arm assembly 30 relative to the base 24 can be done mechanically or electrically as opposed to manually. In some embodiments, an outer ring of the slewing bearing 46 can be a gear toothed ring which can be engaged by a screw motor 48 to rotate the outer ring, and thus the mechanical arm assembly 30 relative to the base 24. While a slewing bearing 46 has been disclosed for allowing for rotation of the mechanical arm assembly 30 relative to the base 24, any suitable rotation enabling system can be implemented to allow for rotation of the mechanical arm assembly 30 relative to the base 24 and can optionally be motorized.

Figure 3:
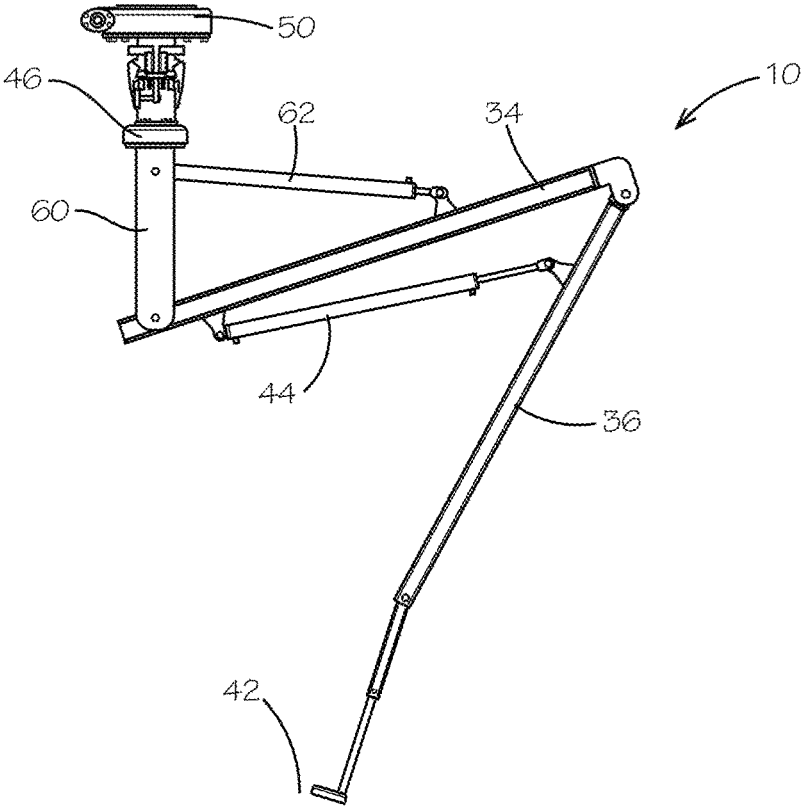
FIG. 3 is a side view of the apparatus of FIG. 1 showing a second actuator retracted to raise a first arm of a mechanical arm assembly of the apparatus.

In some embodiments, as shown in FIGS. 1 and 3, the mechanical arm assembly 30 can include a mounting bracket 60 rotatably connected to the base 24, the first arm 34 connected to the mounting bracket 60 such that the first arm 34 is rotatably connected to the base 24 via the mounting bracket 60. The mounting bracket 60 can be connected to the first slewing bearing 46 in such embodiments to allow for rotation of the mounting bracket 60, and thus the first arm 34, via the slewing bearing 46. In some embodiments, the first arm 34 can be pivotally connected to the mounting bracket 60, and the mechanical arm assembly 30 can further include a second actuator 62 connected between the mounting bracket 60 and the first arm 34, the second actuator 62 operable to rotate the first arm 34 relative to the mounting bracket 60 in a vertical direction or along a vertical plane. Rotation of the first arm 34 can allow for smaller vertical adjustments of the second arm 36 as needed to engage the latch on the barge lid without having to move the overall vertical position of the apparatus 10 via the overhead lifting system.

First and second actuators 44 and 62 are shown as piston or cylinder systems that can be retracted or extended to adjust the rotations of the second arm 36 relative to the first arm 34 and the first arm 34 to the mounting bracket 60 respectively. The piston or cylinder systems can be driven pneumatically, hydraulically, or via motorized linear actuator systems in different embodiments. In other embodiments, various other mechanisms for providing rotational movement between the first and second arms 34 and 36 and the first arm and the mounting bracket 60 can be utilized.

Figure 4:
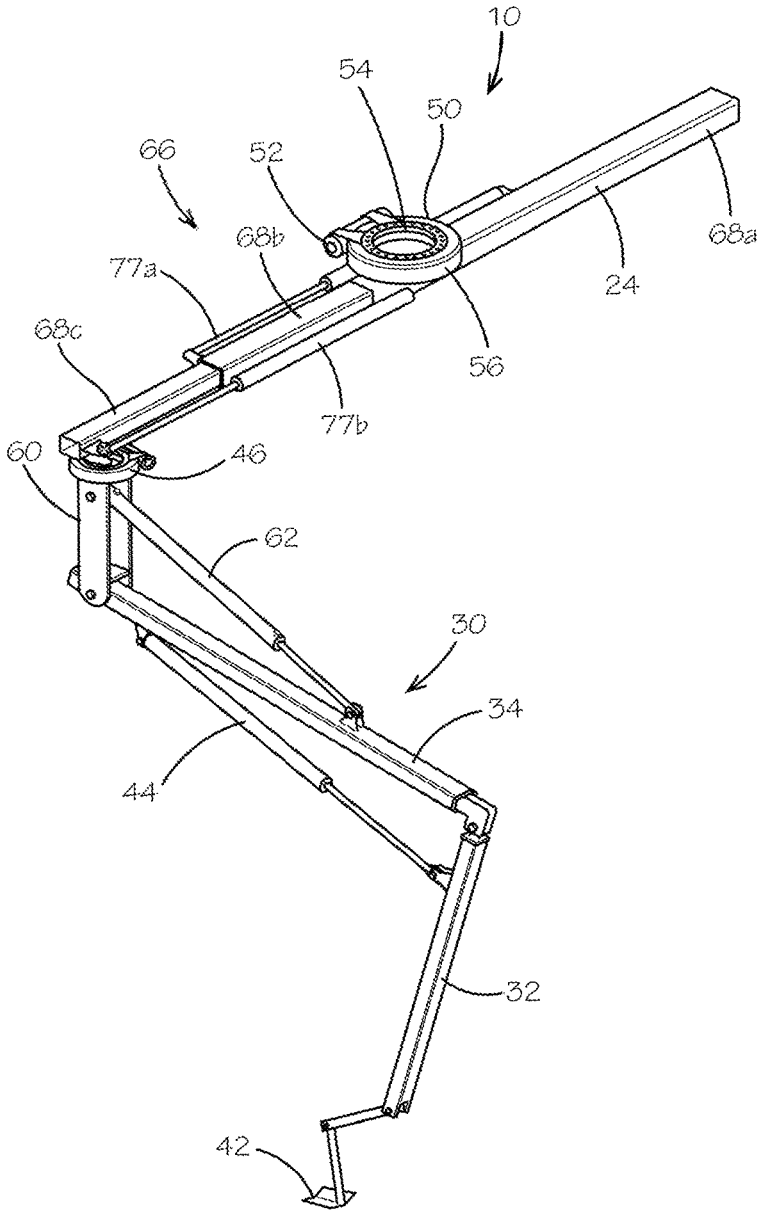
FIG. 4 is a perspective view of another embodiment of an apparatus of the present disclosure for opening a barge lid grain door including a base with a telescoping railing system.
Figure 5:
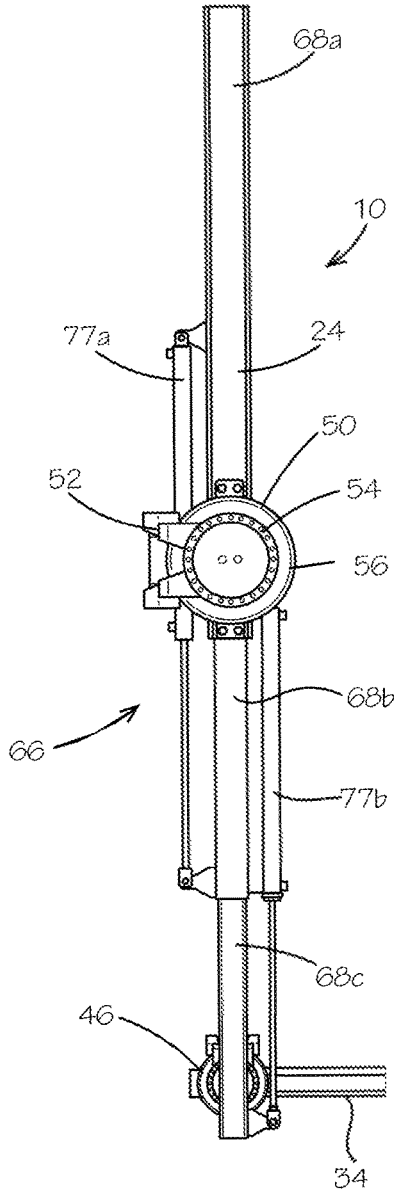
FIG. 5 is a top view of the apparatus of FIG. 4.
Figure 6:
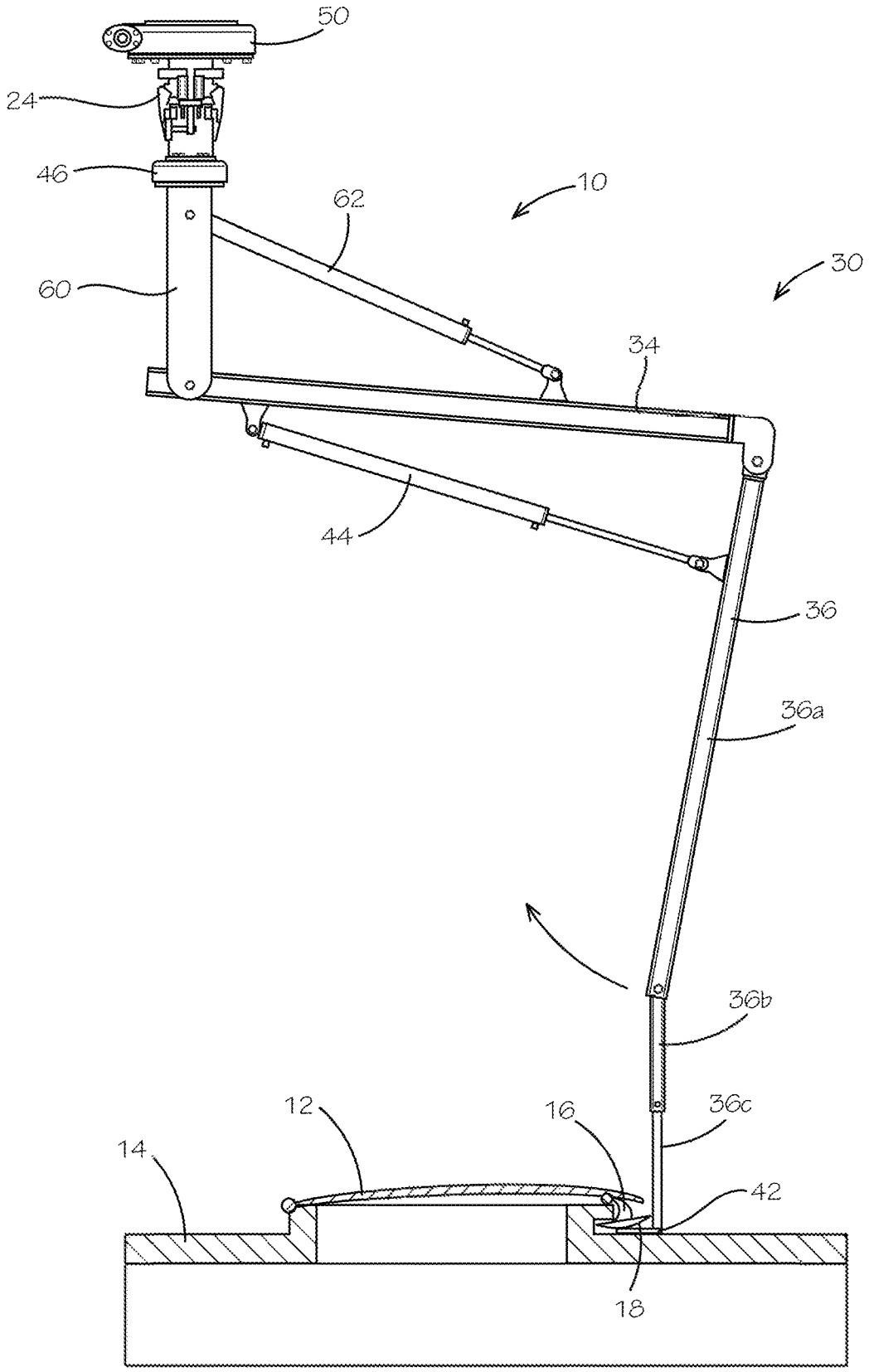
FIG. 6 is a side view of the apparatus of FIG. 1 positioned over a grain door barge lid in position to open the grain door.

In some embodiments, as shown in FIGS. 1 and 4-5, at least a portion of the base 24 can be rotatable relative to the overhead lifting structure via a second slewing bearing 50 such that the base 24 can rotate relative to the crane or hoist in addition to the first arm 34 being rotatable relative to the base 24. The second slewing bearing 50 can generally operate similarly to the first slewing bearing 46 discussed herein. In some embodiments, the overhead lifting structure can be connected to a fixed ring 54 of the second slewing bearing 50, and a rotatable ring 56 can be connected to the base 24 such that the base 24 can rotate relative to the overhead lifting system. In other embodiments, a first portion of the base 24 can be fixedly connected to the lifting system and a second portion of the base 24 can be rotatable relative to the first portion of the base 24 and the lifting system. In some embodiments, the base 24 can be rotatable relative to the overhead lifting system through at least 180 degrees of rotation. In other embodiments, the base 24 can be rotatable relative to the overhead lifting system through 360 degrees of rotation.

Figure 13:
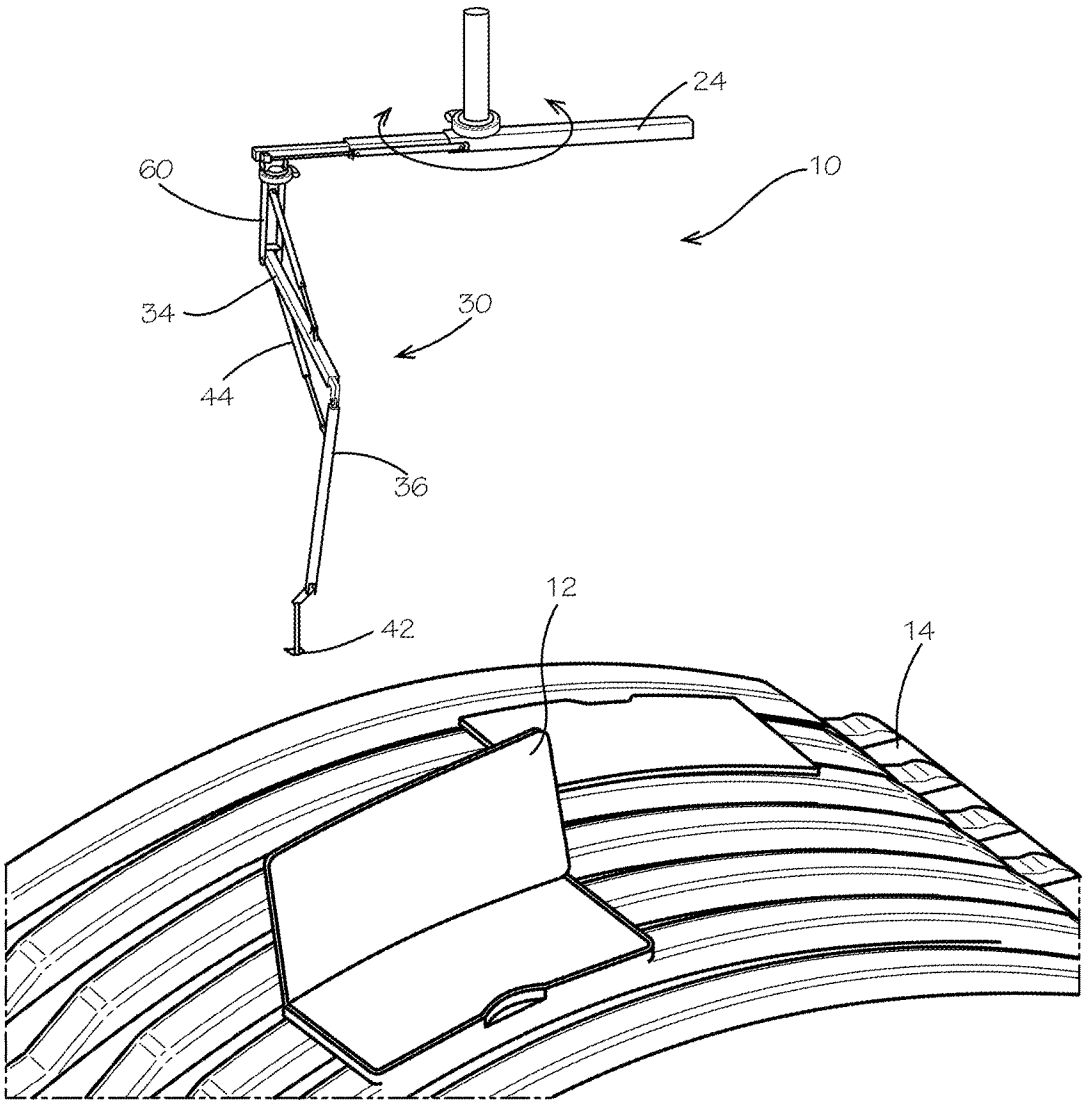
FIG. 13 is a perspective view of the apparatus of FIG. 5 with the mechanical arm assembly positioned over a first lateral grain door on a barge lid.
Figure 14:
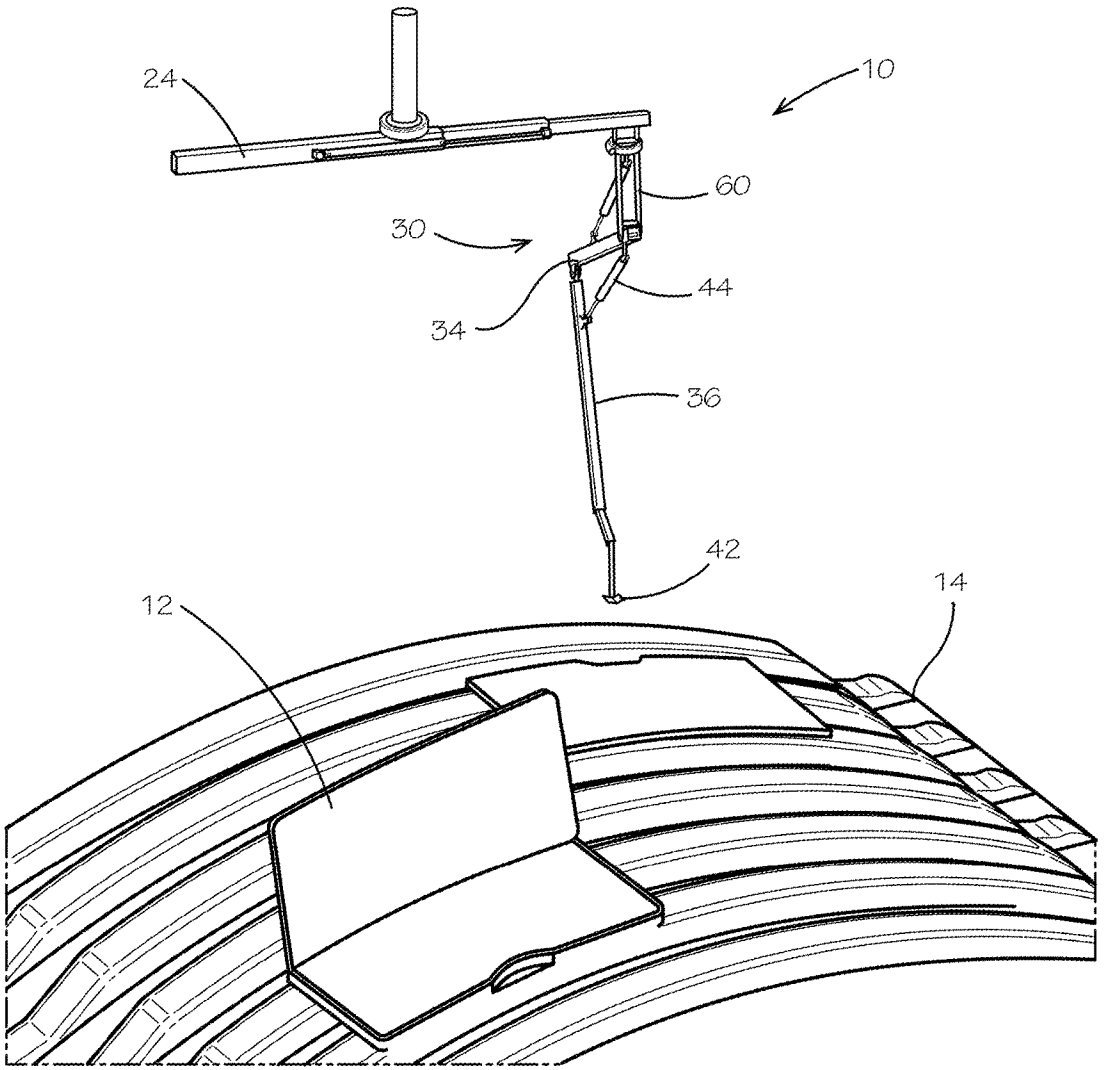
FIG. 14 is a perspective view of the apparatus of FIG. 13 with a rail system of a base of the apparatus rotated to a position with the mechanical arm assembly located over and suitable for engaging an opposing lateral grain door on the barge lid.

As shown in FIGS. 1-6, in some embodiments, the base 24 can include a rail system 66 connectable to or supportable by the overhead lifting system, and the mechanical arm assembly 30 can be connected to the rail system 66 such that the mechanical arm assembly 30 can be laterally spaced from the overhead lifting system or a connection point between the overhead lifting system and the rail system 66 when the rail system 66 is connected to the overhead lifting system. The apparatus of claim 8, wherein the rail system is rotatably connectable to the overhead lifting system, such that the mechanical arm assembly can be selectively rotated to a position on the opposite lateral side of the overhead lifting system via the rail system 66, as shown in FIGS. 13-14.

Figure 2:
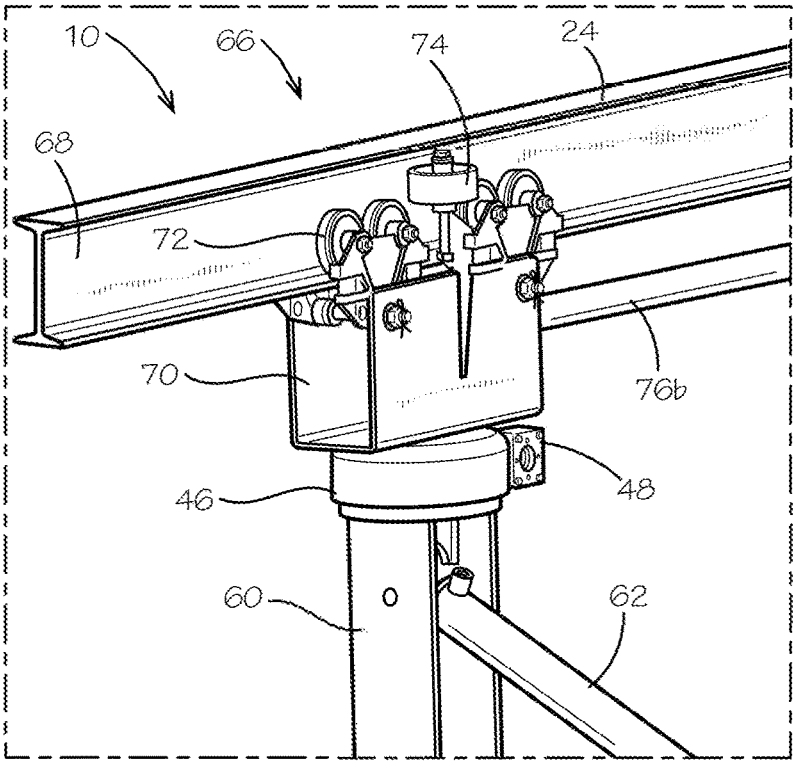
FIG. 2 is a detailed perspective view of a trolley assembly of the apparatus of FIG. 1.

In some embodiments, as shown in FIGS. 1 and 2, the mechanical arm assembly 30 can be translatable on the rail system 66. The rail system 66 can include a single rail member 68 and a trolley assembly 70 that can slide along the rail member 68. The first arm 34 and/or the mounting bracket 60 can be rotatably connected to the trolley assembly 70 such that the first arm 34 and/or mounting bracket 60 can be rotatable relative to the base 24 via the trolley assembly 70. The trolley assembly 70 can include a plurality of rollers 72 that can allow the trolley assembly 70 to roll along the rail 68. The trolley assembly 70 can also include horizontally oriented rollers 74 positioned on either side of the rail 68 to stabilize the trolley assembly 70, and thus the mechanical arm assembly 30 on the rail 68.

One or more trolley actuators 76 can be mounted on the rail 68 and coupled to the trolley assembly 70 and/or one another to control movement of the trolley assembly 70 on the rail 68. As shown in FIG. 1, when multiple trolley actuators 76 are used, one trolley actuator 76*a* can be fixedly connected to the rail 68, and a second trolley actuator 76*b* can be mounted on its own trolley assembly 78 to translate along with the trolley assembly 70 when the fixed trolley actuator 76*a* is actuated. The second trolley actuator 76*b* can subsequently be actuated if further movement of the trolley assembly 70 is desired. Translational movement of the mechanical arm assembly 30 on the rail 68 can allow for a lateral position of the mechanical arm assembly 30 relative to the barge container or the barge lid to be adjusted without adjusting the overall position of the apparatus 10 via the overhead lifting system.

In another embodiment, as shown in FIGS. 4 and 5, the rail system 66 can be a telescoping rail system. The rail system 66 can include two or more rail members 68*a*, 68*b*, and 68*c* that can be slidably disposed with respect to one another. A first rail member 68*a* can be fixedly or rotatably connected to the overhead lifting system. A second rail member 68*b* can be slidably disposed on the first rail member 68*a*, and in some embodiments, a third rail member 68*c* can be slidably disposed on second rail member 68*b*. The mechanical arm assembly 30 can be mounted on the distal rail member (68*c* in FIGS. 4 and 5) from the overhead lifting system and the position of the mechanical arm assembly 30 can be adjusted by sliding the two or more rail members 68*a*, 68*b*, and 68*c* relative to one another. In some embodiments, one or more telescoping actuators 77 can be coupled between subsequent rail members 68 and can be actuated to adjust the lateral position of the mechanical arm assembly 30 relative to the below barge lid or cover. For instance, first telescoping actuator 77*a* can be coupled between first rail member 68*a* and 68*b*, and second telescoping actuator 77*b* can be coupled between second rail member 68*b* and third rail member 68*c*. The first telescoping actuator 77*a* can be actuated to adjust the position of the mechanical arm assembly 30, and the second telescoping actuator 77*b* can be actuated if additional adjustment/extension is needed or desired.

As can be shown in FIGS. 6-10, in order to open a grain or access door 12 on a barge lid 14, the apparatus 10 can be moved into a suitable position over the grain door 12 with the latch engagement member 42 positioned adjacent the latch 16. In some embodiments, the latch engagement member 42 can extend transversely from the distal end 40 of the second arm 36 which that, when the actuator 44 is extended and the second arm is oriented in a downward direction, the latch engagement member 42 can be oriented in a substantially horizontal orientation such that the latch engagement member 42 can be maneuvered beneath the latch 16 as the actuator 44 is retracted and the second arm 36 is rotated relative to the first arm 34. In some embodiments, the latch engagement member 42 can have a substantially V-shaped, U-shaped, or C-shaped cross-section, which can allow for a margin of error in aligning the latch engagement member 42 with the latch 16. As the latch engagement member 42 moves toward the latch 16, the V-shaped, U-shaped, or C-shaped cross section of the latch member 42 can force the latch engagement member 42 to align itself with the latch 16 such that the latch 16 is generally seated in a center of the latch engagement member 42. The V-shaped, U-shaped, or C-shaped cross section of the latch engagement member 42 can also help maintain engagement of the latch 16 by the latch engagement member 42 during the lifting process as the upward angle of the latch engagement member 42 sidewalls can help prevent the latch 16 from slipping out of the latch engagement member 42.

Figure 7:
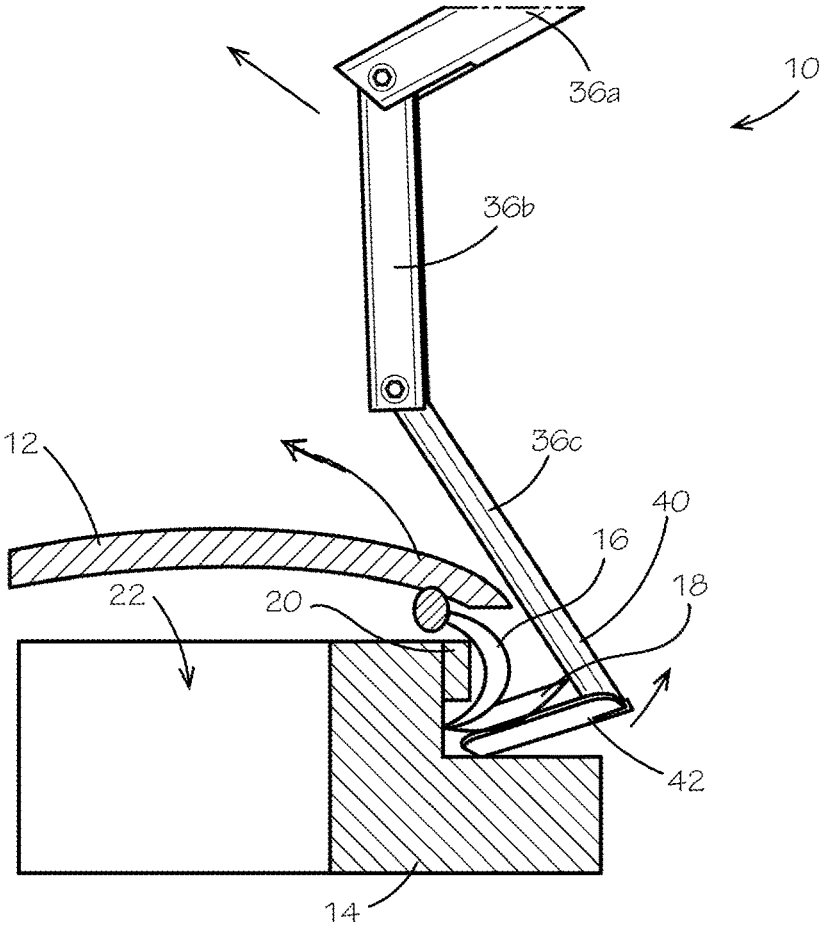
FIG. 7 is a detailed side view of the latch engagement member of the apparatus of FIG. 6 engaging a latch on the grain door.
Figure 8:
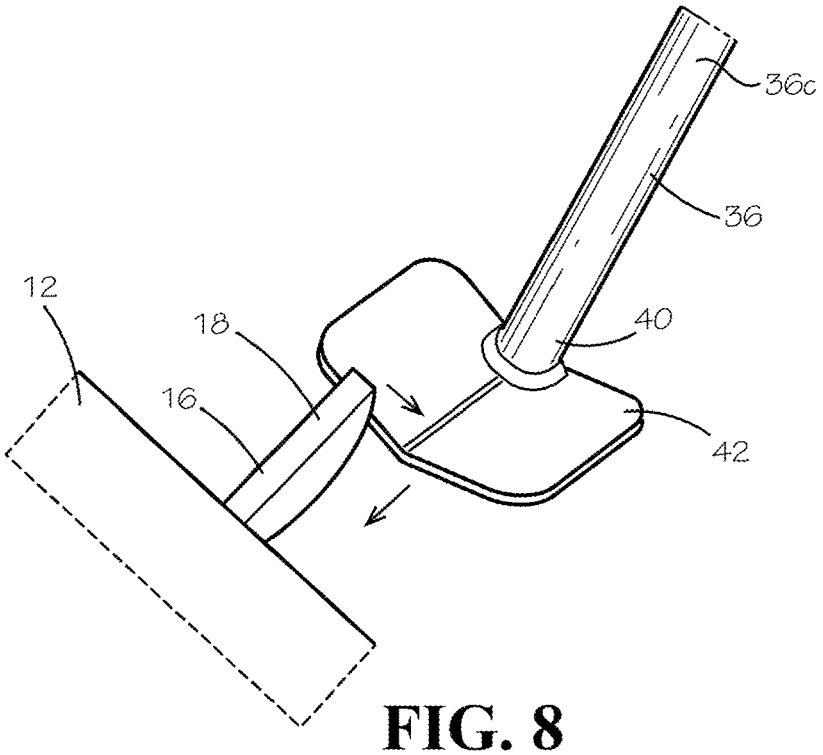
FIG. 8 is a side perspective view of the latch engagement member of FIG. 8 sliding beneath a latch of a grain door during an opening operation.

As can be seen in FIGS. 6-7, in some embodiments, second arm 36 can have multiple arm second segments 36*a*, 36*b*, and 36*c*. The second arm segments 36*a*, 36*b*, and 36*c* can all be pivotally connected together. As the actuator 44 is retracted, the various second arm segments 36*a*, 36*b*, and 36*b* can pivot with respect to one another during the lifting process to accommodate the movement of the second arm 36 in response to the retraction of actuator 44. The pivoting of the second arm members 36*a*, 36*b*, and 36*c*, and particularly the distal second arm member 36*c*, can allow the latch engagement member 42 to apply a force on the latch 16 which is offset from the pivot point of the latch 16 such that the latch 16 can be rotated and disengaged from the barge lid 14 such that the grain door 12 can be swung open by second arm 36 as the actuator 44 continues to retract and swing second arm segments 36*a*, 36*b*, and 36*c* to a retracted position, as shown in FIG. 9. In some embodiments, while the second arm segments 36*a*, 36*b*, and 36*c* can pivot with respect to one another, the range of pivoting in a backward direction (counterclockwise in FIGS. 6-9) can be limited such that the second arm segments 36*a*, 36*b*, and 36*c* don't pivot too far under the weight of the grain door 12 and drop the grain door 12 during lifting.

Once the grain door 12 is swung open by the apparatus 10, a pump for grain or other material can be positioned over the grain door to fill the barge. Once filling is complete, the mechanical arm assembly 30 can be rotated 180 degrees via first slew bearing to a position suitable for closing the grain door 12. The actuator 44 can be extended and the latch engagement member 42 can be positioned adjacent the grain door 12 as shown in FIG. 11. The actuator 44 can be retracted again and the latch engagement member 42 can engage the grain door 12 and/or the latch 16 to swing the grain door 12 as shown in FIG. 12 until the grain door 12 falls back to a closed position with the latch 16 engaged with the lid 14.

Figure 19:
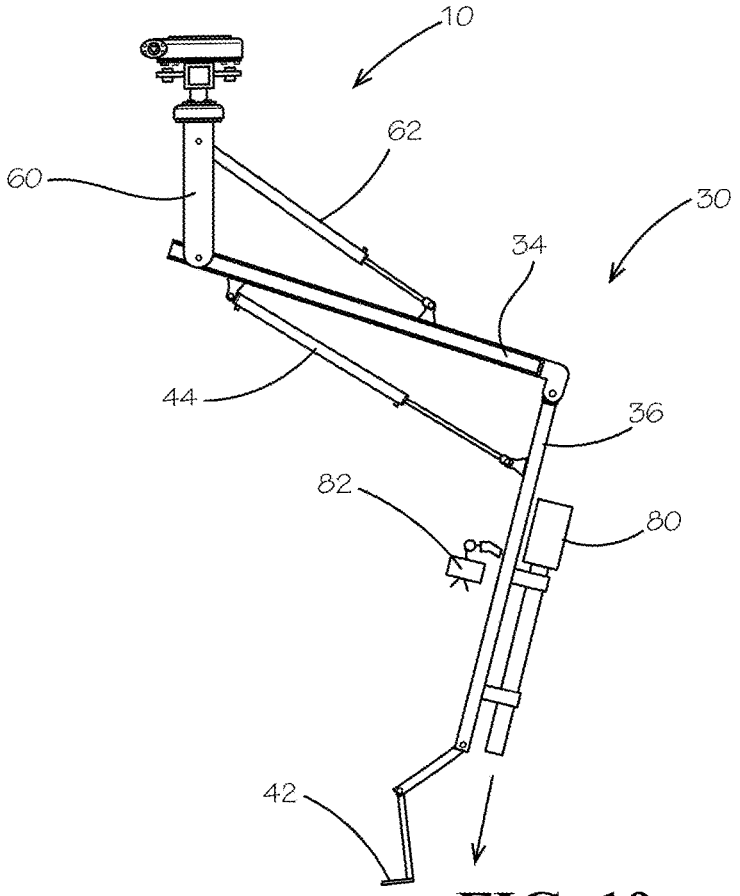
FIG. 19 is a side view of another embodiment of an apparatus of the present disclosure for opening a grain door on a barge lid including a blower assembly and one or more cameras for viewing engagement of the apparatus with the grain door.

In some embodiments, the apparatus 10 can further include a blower assembly 80 mounted on the base, the first arm, or the second arm, as shown in FIG. 19 the blower oriented to blow forced air in a downward direction across the barge lid during use to blow away any debris or grain on the lid after the filling operation is complete.

Figure 20:
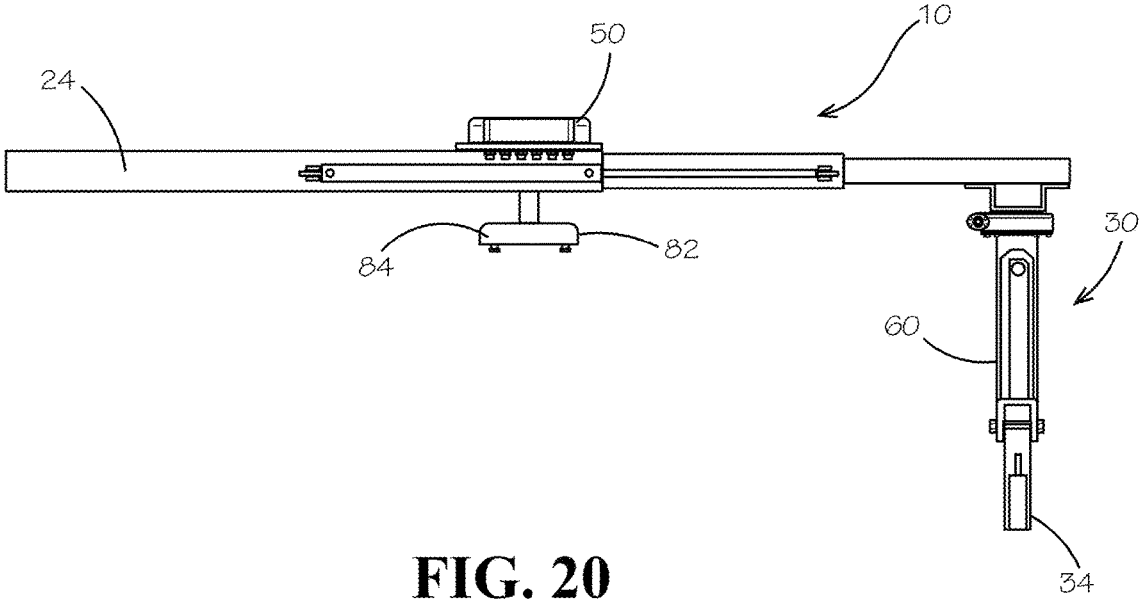
FIG. 20 is a back view of another embodiment of an apparatus of the present disclosure for opening a grain door on a barge lid including a combination camera and LIDAR system for viewing engagement of the apparatus with the grain door and for monitoring height levels of the apparatus and/or the load being filled in the barge.

In some embodiments, as shown in FIGS. 19 and 20, a camera 82 can be mounted on the base 24, the first arm 34 or the second arm 36 and oriented towards the latch engagement member 42 to help an operator, in an operating room offsite from the barge, better see the engagement of the latch engagement member 42 and the latch.

In some embodiments, the apparatus 10 can be equipped with LIDAR 84 scanning capabilities which can help an operator determine either the height of grain or other materials within the barge, or the height of the apparatus 10 above the lid so the operator can tell whether the apparatus 10 is at a proper height above the lid for opening and closing the grain door. In some embodiments, the LIDAR readings can be fed back to the overhead lifting system to automatically control operation of the lifting system to adjust the height of the apparatus 10 to an appropriate height above the lid.

Figure 16:
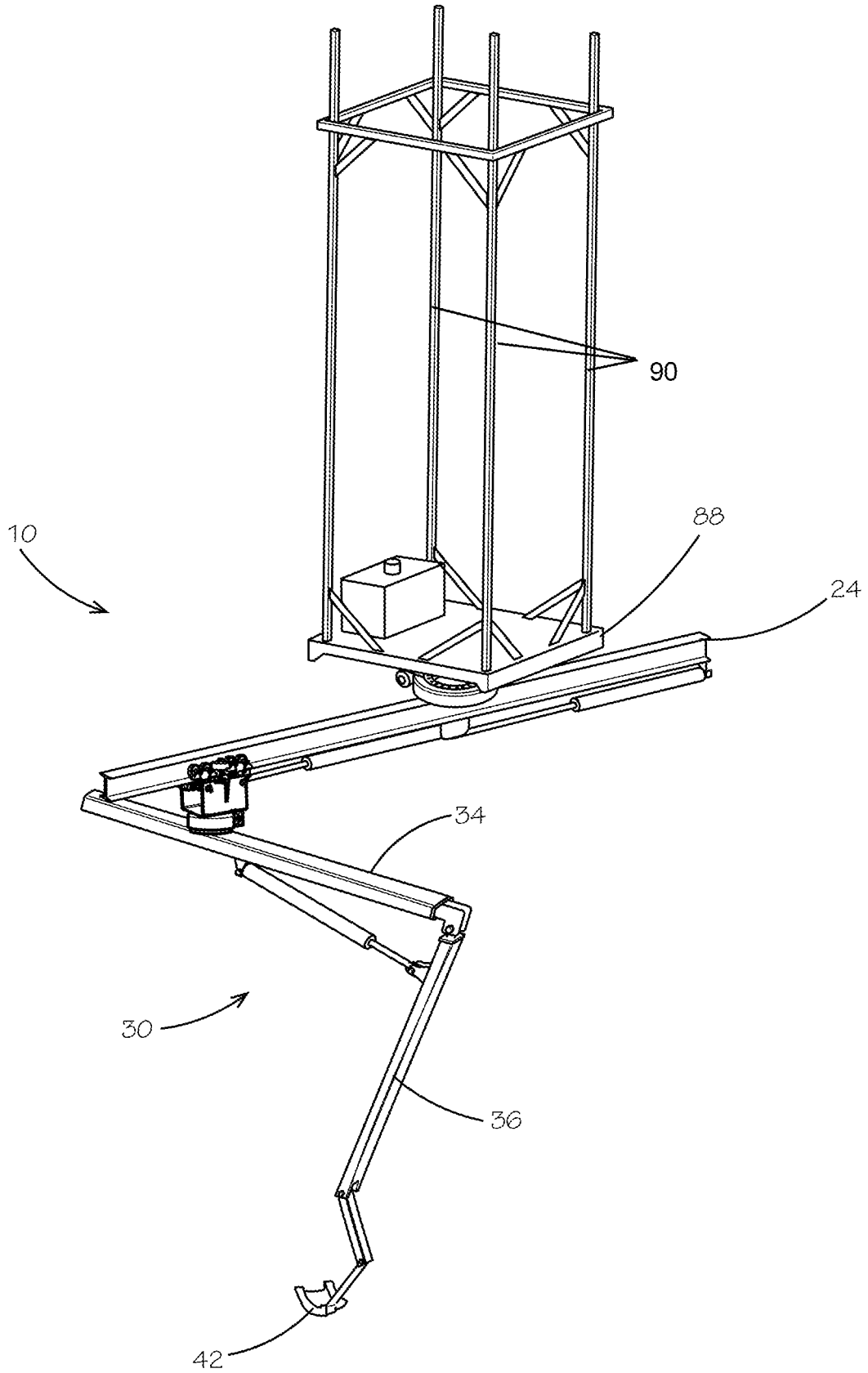
FIG. 16 is a perspective view of another embodiment of an apparatus of the present disclosure for opening a grain door on a barge lid including a stabilization system between a base of the apparatus and the overhead lifting system.

In some embodiments, the base 24 can include a stabilization system which can help control undesired twisting or rotation of the apparatus 10 during an actuation of the mechanical arm assembly 30 during a grain door opening or closing operations. In some embodiments, as shown in FIG. 16, the stabilization system can include a platform 88 connected to the base 24 or the second slew bearing 50 associated with the base 24. A plurality of stabilizing rods 90 can extend upward from the platform 88 and be received in guide holes or slots defined in the lifting system such as a hoist support rail. The stabilization rods 90 can slide through the guide holes or slots as the apparatus 10 is lifted or lowered by the lifting system. Thus, vertical movement of the apparatus 10 is not inhibited. But the stabilizing rods 90 can prevent unwanted rotation or swinging of the base 24 for instance due to movement of the mechanical arm assembly 30.

Figure 17:
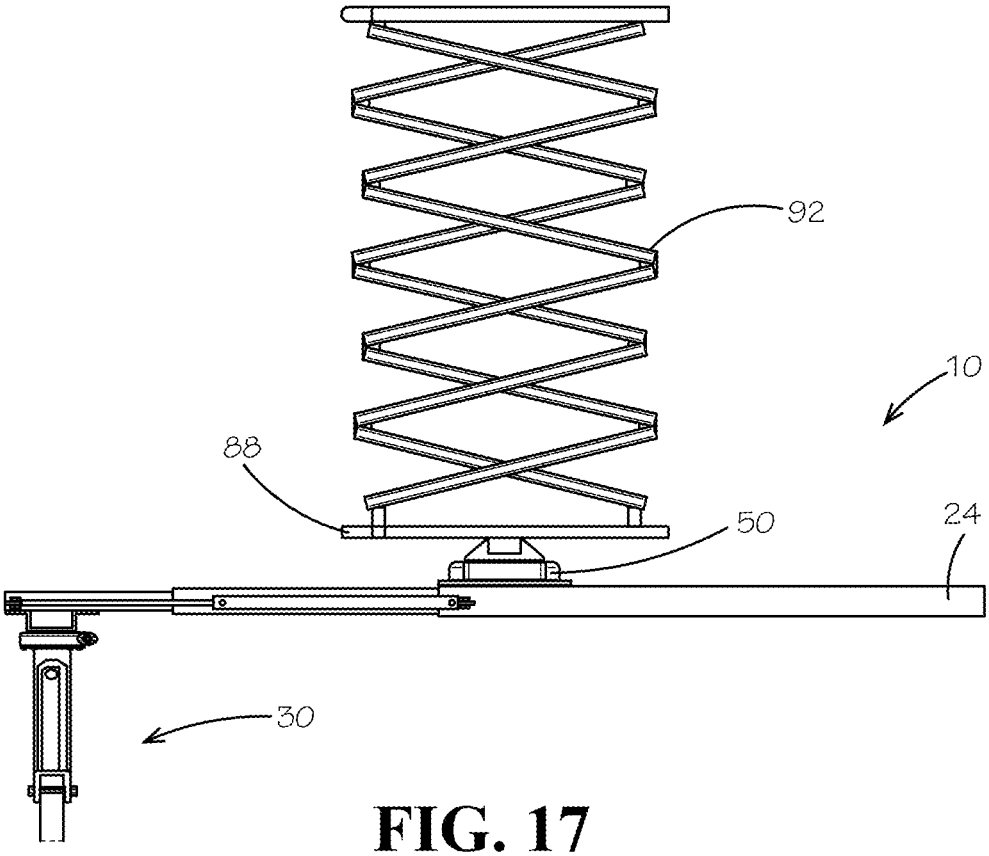
FIG. 17 is a perspective view of another embodiment of an apparatus of the present disclosure for opening a grain door on a barge lid including a stabilization system between a base of the apparatus and the overhead lifting system, the stabilization system including a scissoring arm assembly.
Figure 18:
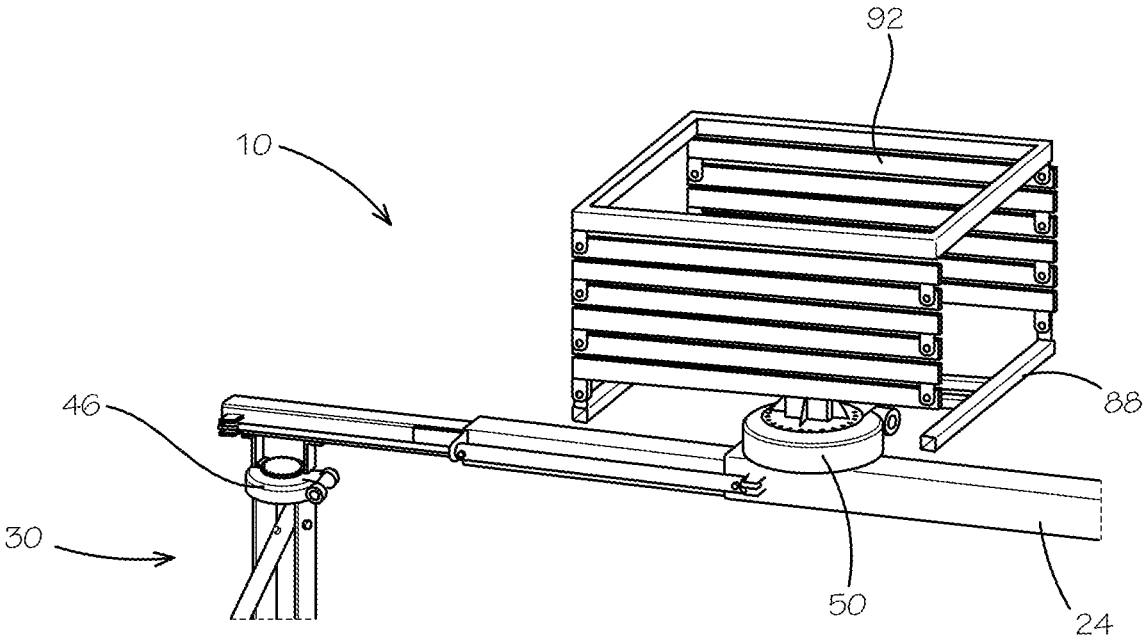
FIG. 18 is a perspective view of the apparatus of FIG. 17 showing the scissoring arm assembly in a retracted or folded orientation.

In other embodiments, as shown in FIGS. 17 and 18, the stabilization system can include scissoring arms 92 connected between various points of the platform 88 and the overhead lifting system. This stabilization system can be beneficial in fixed overhead structures such as in enclosed barge docks, as the required overhead space associated with the sliding rods of FIG. 16 can be reduced as the scissoring arms 92 can be collapsed upon themselves as shown in FIG. 18 as the apparatus 10 is raised, while still providing adequate stabilization.

The apparatus 10 of the present disclosure can be deployed to open and close grain doors in a single station or may be deployed at separate points in the process (i.e., one station to open and the other station to close the door). When not in deployment the apparatus can be moved or indexed away from the door opening to allow access for the filling process. A robotic or rigid arm can be configured to disengage a latch on the grain door from the barge lid and subsequently swing the grain door open. In other embodiments, the mechanical arm assembly include a rigid arm having a laterally extending distal end including an inclined plane angled with respect to a horizontal reference axis. The rigid opening arm can take advantage of movement of a barge, the inclined plane engaging the latch on the grain door and forcing the latch to disengage from the barge lid as the barge moves in the water. As the barge continues to move, the arm can force the grain door to swing open. In other embodiments, the boom or host structure can be movable above the grain door to engage the rigid arm with the latch and the grain door. In still other embodiments, the door opening arm can be positioned on a track on the host structure or boom such that the door opening arm can be translatable on the host structure or boom. In some embodiments, multiple rigid arms can be mounted to the boom, one configured for opening the grain door and the other for closing, depending on the movement of the barge or the boom. In some embodiments, the rigid arms can be vertically adjustable such that they can be retracted when not in use to avoid interference with the movement of the grain door.

The apparatus can clean the barge cover of dust and debris upon completion of the filling process at each station. Cleaning can be provided as part of a single station operation, or can be executed at a secondary station associated with a cover closing operation. Various media can be utilized to accomplish the cleaning process as appropriate for the material being loaded and site capability.

The apparatus could position instrumentation to monitor and report the status of the material being loaded in the barge that could assist in amount and distribution of the load. Load information could also be provided by a more general method of monitoring the overall position and draft of the barge as it is being loaded. This information could also be used to inform documentation required for navigation over the inland waterway systems.

Figure 21:
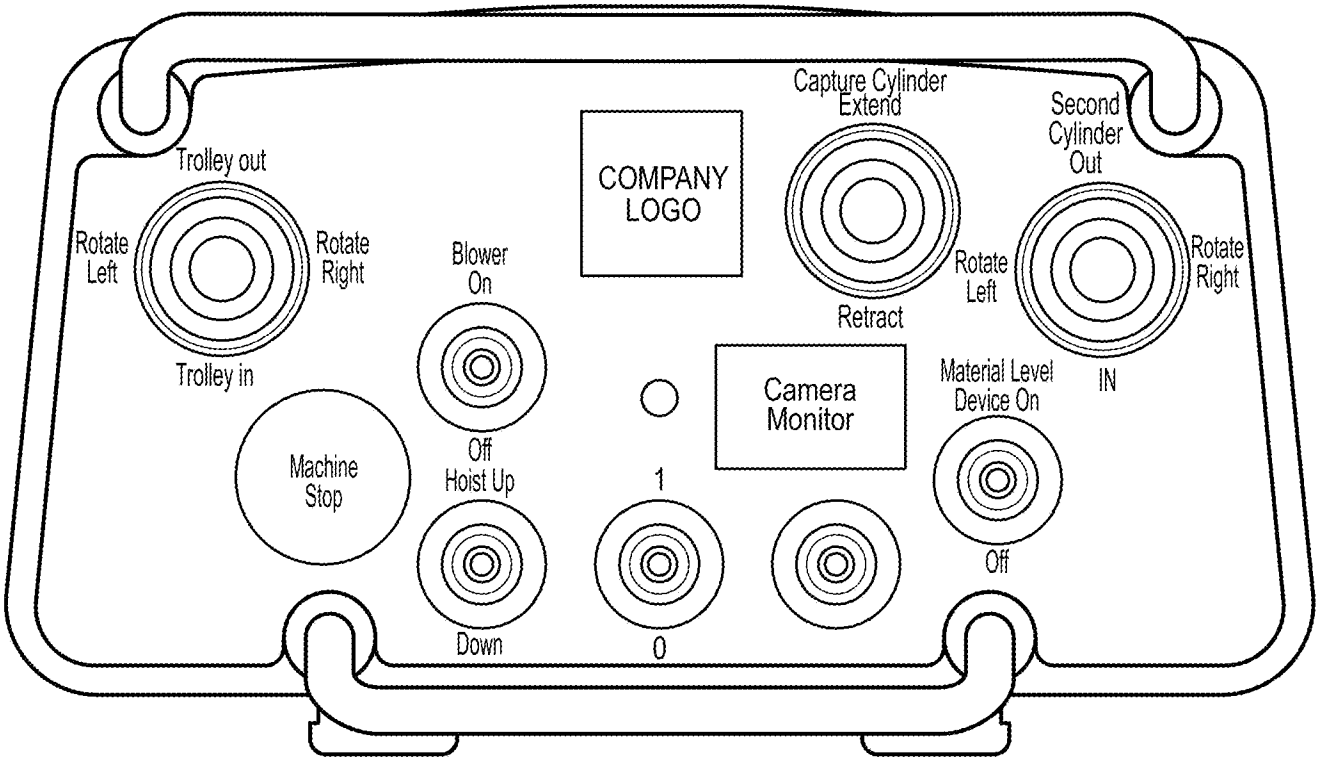
FIG. 21 is an exemplary plan view of a controller for the barge lid grain door opening apparatus of the present disclosure.

All functions of the apparatus can be controlled remotely by an operator with line of site and/or camera assist may be employed if operator is out of the line of site. Remote control can be provided by means of radio interface or hardwired as needed to accommodate site specific conditions. All control and powered functions can be provided to accommodate area classifications for electric and power devices as well as safety standards. An exemplary control device is shown in FIG. 21.

Thus, although there have been described particular embodiments of the present invention of a new and useful BARGE LID GRAIN DOOR OPENING APPARATUS, it is not intended that such references be construed as limitations upon the scope of this invention.

What is claimed is:

1. An apparatus for opening and closing a grain door on a barge lid, the grain door having a latch connecting the grain door to the barge lid, the apparatus supportable by an overhead lifting system, the apparatus comprising:

a base supportable by the overhead lifting system;

a mechanical arm assembly rotatably connected to the base, the mechanical arm assembly including:

a first arm rotatably connected to the base;

a second arm having a proximal end and a distal end, the proximal end pivotally connected to the first arm;

a latch engagement member connected to the distal end of the second arm; and an actuator connected between the first arm and the second arm, the actuator operable to move the second arm relative to the first arm when the apparatus is positioned over the grain door to disengage the latch on the grain door from the barge lid via the latch engagement member and swing the grain door from a closed position to an open position.

2. The apparatus of claim 1, wherein when the apparatus is supported by the overhead lifting system, the first arm is rotatable about the base along a horizontal plane, and the second arm extends in a downward direction from the first arm.

3. The apparatus of claim 1, wherein the first arm is connected to the base via a first slewing bearing such that the first arm is rotatable relative to the base via the slewing bearing.

4. The apparatus of claim 3, wherein at least a portion of the base is rotatable relative to the overhead lifting system via a second slewing bearing such that at least a portion of the base can rotate relative to the crane or hoist and the first arm can rotate relative to the base.

5. The apparatus of claim 1, wherein the latch engagement member extends transversely to the distal end of the second arm, and the latch engagement member has a substantially V-shaped, U-shaped, or C-shaped cross section.

6. The apparatus of claim 1, wherein the mechanical arm assembly further comprises a mounting bracket rotatably connected to the base, the first arm connected to the mounting bracket such that the first arm is rotatably connected to the base via the mounting bracket.

7. The apparatus of claim 6, wherein:

the first arm is pivotally connected to the mounting bracket; and the mechanical arm assembly further comprises a second actuator connected between the mounting bracket and the first arm, the second actuator operable to rotate the first arm relative to the mounting bracket in a vertical direction.

8. The apparatus of claim 1, wherein the base is a rail system connectable to the overhead lifting system, and the mechanical arm assembly is connected to the rail system such that the mechanical arm assembly is laterally spaced from the overhead lifting system on the rail system when the rail system is connected to the overhead lifting system.

9. The apparatus of claim 8, wherein the rail system is rotatably connectable to the overhead lifting system, such that the mechanical arm assembly can be selectively rotated to a position on the opposite lateral side of the overhead lifting system via the rail system.

10. The apparatus of claim 8, wherein the rail system is a telescoping rail system.

11. The apparatus of claim 8, wherein the mechanical arm assembly is translatable on the rail system.

12. The apparatus of claim 1, wherein the first arm is rotatable on the base through at least 180 degrees of rotation.

13. The apparatus of claim 1, further comprising a blower assembly mounted on the base, the first arm, or the second arm, the blower oriented to blow forced air in a downward direction.

14. The apparatus of claim 1, further comprising a camera mounted on the base, the first arm, or the second arm, the camera oriented to view the second arm of the mechanical arm assembly.

15. An apparatus for opening and closing a grain door on a barge lid, the grain door having a latch connecting the grain door to the barge lid, the apparatus supportable by an overhead lifting system, the apparatus comprising:

a base supportable by the overhead lifting system, at least a portion of the base rotatable relative to the overhead lifting system when supported by the overhead lifting system;

a mechanical arm assembly rotatably connected to the portion of the base rotatable relative to the overhead lifting system at a point spaced on the base from the overhead lifting system, the mechanical arm assembly including:

a first arm rotatably connected to the base;

a second arm having a proximal end and a distal end, the proximal end pivotally connected to the first arm;

a latch engagement member connected to the distal end of the second arm; and an actuator connected between the first arm and the second arm, the actuator operable to move the second arm relative to the first arm when the apparatus is positioned over the grain door to disengage the latch on the grain door from the barge lid via the latch engagement member and swing the grain door from a closed position to an open position.

16. The apparatus of claim 15, further comprising:

a first slew bearing rotatably connecting the mechanical arm assembly to the base; and a second slew bearing connected to the portion of the base that is rotatable relative to the overhead lifting system when the base is supported by the overhead lifting system.

17. The apparatus of claim 15, wherein:

the first arm is rotatable relative to the base through at least 180 degrees of rotation; and the at least a portion of the base rotatable relative to the overhead lifting system is rotatable relative to the overhead lifting system through at least 180 degrees of rotation.

18. An apparatus for opening and closing a grain door on a barge lid, the grain door having a latch connecting the grain door to the barge lid, the apparatus supportable by an overhead lifting system, the apparatus comprising:

a base supportable by the overhead lifting system, the base including an elongated railing system rotatable relative to the overhead lifting system when supported by the overhead lifting system;

a mechanical arm assembly rotatably connected to the rail system at a point spaced on the base from the overhead lifting system, the mechanical arm assembly including:

a first arm rotatably connected to the rail system;

a second arm having a proximal end and a distal end, the proximal end pivotally connected to the first arm;

a latch engagement member connected to the distal end of the second arm; and an actuator connected between the first arm and the second arm, the actuator operable to move the second arm relative to the first arm when the apparatus is positioned over the grain door to disengage the latch on the grain door from the barge lid via the latch engagement member and swing the grain door from a closed position to an open position.

* * * * *